US008291631B2

(12) United States Patent
Wilder

(10) Patent No.: US 8,291,631 B2
(45) Date of Patent: Oct. 23, 2012

(54) POP-UP SEMI SELF-CONSTRUCTING DISPLAY

(75) Inventor: Andrew Z. Wilder, Brewster, NY (US)

(73) Assignee: Panel Prints, Inc., Old Forge, PA (US)

( * ) Notice: Subject to any disclaimer, the term of this patent is extended or adjusted under 35 U.S.C. 154(b) by 1473 days.

(21) Appl. No.: 11/465,538

(22) Filed: Aug. 18, 2006

(65) Prior Publication Data

US 2008/0000123 A1 Jan. 3, 2008

Related U.S. Application Data

(60) Provisional application No. 60/806,435, filed on Jun. 30, 2006.

(51) Int. Cl.

| | |
|---|---|
| ***G09F 3/18*** | (2006.01) |
| ***G09F 15/02*** | (2006.01) |
| ***G09F 15/00*** | (2006.01) |
| ***G09F 1/00*** | (2006.01) |
| ***A47G 1/17*** | (2006.01) |

(52) U.S. Cl. ..... 40/661.09; 40/760; 40/606.12; 40/124.07; 40/124.08; 40/539; 40/446; 40/610

(58) Field of Classification Search ..... 40/661.09, 40/760, 606.12, 124.07, 124.08, 539, 446, 40/610

See application file for complete search history.

(56) References Cited

U.S. PATENT DOCUMENTS

| | | | | |
|---|---|---|---|---|
| 4,033,060 | A * | 7/1977 | Lawrence | 40/760 |
| 4,700,498 | A | 10/1987 | Perutz et al. | |
| 5,106,126 | A * | 4/1992 | Longobardi et al. | 283/94 |
| 5,416,997 | A * | 5/1995 | Dyment et al. | 40/610 |
| D378,301 | S | 3/1997 | Leksell | |
| 5,619,816 | A | 4/1997 | Ellison | |
| 5,787,621 | A | 8/1998 | Leksell | |
| 5,966,857 | A | 10/1999 | Pettersson et al. | |
| 5,971,612 | A * | 10/1999 | McAuslan | 383/43 |
| 6,173,515 | B1 * | 1/2001 | Walsh | 40/124.08 |
| 6,558,297 | B1 * | 5/2003 | Brown et al. | 482/77 |
| 6,594,934 | B1 | 7/2003 | Wong | |
| 6,598,840 | B1 | 7/2003 | Siegl | |
| D490,116 | S | 5/2004 | Epp | |
| 6,766,538 | B2 | 7/2004 | Park | |
| 6,829,863 | B2 * | 12/2004 | Lovas | 52/211 |
| 7,134,230 | B1 * | 11/2006 | Boens et al. | 40/610 |
| 7,392,609 | B1 * | 7/2008 | Miska | 40/124.07 |
| 2004/0159031 | A1 | 8/2004 | Chang | |
| 2004/0191450 | A1 | 9/2004 | McGuinness et al. | |
| 2005/0160645 | A1 | 7/2005 | Williams et al. | |

FOREIGN PATENT DOCUMENTS

| | | |
|---|---|---|
| EP | 0707821 | 4/1996 |
| WO | WO9636958 | 11/1996 |

* cited by examiner

*Primary Examiner* — Tashiana Adams
*Assistant Examiner* — Syed A Islam
(74) *Attorney, Agent, or Firm* — Mitchell A. Smolow

(57) ABSTRACT

The present invention comprises a point of sale display having two joined flexible substrates capable of receiving a display material, each substrate having at least one leaf spring attached thereto and at least one fold line. Upon activation of the leaf springs, the substrates form curved surfaces, thereby giving the display a three dimensional form. The leaf springs and fold lines allow the display to be compressed flat and folded for shipping and storage.

26 Claims, 7 Drawing Sheets

POP-UP SEMI SELF-CONSTRUCTING DISPLAY

CROSS REFERENCE TO RELATED APPLICATIONS

This application claims benefit of U.S. Provisional Application No. 60/806,435 filed Jun. 30, 2006.

FIELD OF THE INVENTION

This invention relates generally to display advertising, and in particular, to a pop-up semi self-constructing display.

BACKGROUND OF THE INVENTION

Portable point of sale (POS) displays are used to display graphics, prints, pictures, advertisements and the like. Known POS portable displays are often elaborately constructed. They are not compact when disassembled, require special shipping containers and setup procedures and may be heavy and/or bulky making them difficult to move in either an assembled or disassembled state. Their weight and/or bulk makes them costly to ship.

For example, U.S. Pat. No. 6,598,840 to Siegl discloses a presentation device having a base and bars plugged together to form a flexible stand, the stand being connected to the base via a plug connection. Transverse bars are used as a holdings device for a presentation carrier for connecting the latter to the base and the stand. For set-up or dismantling, the base is designed with four elongate foldable feet which are articulated on an elongate cross member and are capable of being pivoted out of a folded-up position of rest parallel to the cross member into an operation position at right angles to the cross member, and back again.

U.S. Pat. No. 4,700,498 to Perutz et al., discloses a portable display apparatus having a display section adapted to assume either an operative or inoperative mode. When in an operative mode, the display section assumes an upright partition-like configuration having a large exposed, display surface. When in an inoperative mode, the display section assumes a collapsed condition suitable for storage. The display section is maintained and supported in the operative mode by structural members. A first set of structural members supportingly and removably engage opposed peripheral portions of the exposed display surface. A second set of structural members are operatively and removably connected to the first set of structural members and maintain the display section in a selected operative mode. The structural members are adapted to assume a disassembled state in which the sets of structural members are adapted to assume side by side substantially parallel relation and be disposed in proximity to the compact unit of the display section.

U.S. Patent Application Publication No. 2005/0160645 to Williams et al. discloses a collapsible signaling device bearing a pair of opposed message panels, convertible between a display configuration and a compact linear storage configuration. The message panels are joined together at spaced points along their periphery using spacers to form a pocket having an internal cavity. A mast is insertable within the pocket and is joined to the panel members at its upper end. A pair of struts of spring material are joined at one end to the upper end of the mast and are joined at their lower ends to a slider member which is slidably movable with respect to the mast. As the slider member is advanced toward the upper end of the mast, the struts are outwardly bowed imparting outwardly directed tension to the periphery of the message panels.

These and other known POS displays have significant limitations enumerated above. Accordingly there is a continuing need for improved portable POS display designs. The present invention fulfills this need and further provides related advantages.

BRIEF SUMMARY OF THE INVENTION

The portable POS display of the present invention comprises two joined flexible substrates capable of receiving a display material, each substrate having at least one leaf spring attached thereto and at least one fold line. Upon activation of the leaf springs, the substrates form curved surfaces, thereby giving the display a three dimensional form. The leaf springs and fold lines allow the display to be compressed flat and folded for shipping and storage.

The present invention also contemplates a method of forming a three dimensional POS display incorporating the design enumerated above.

The display just described has important advantages over the prior art. One advantage is that each self standing display minimizes the number of parts required and the potential loss of parts particularly if the displays are taken down for a subsequent later use.

Another advantage is that since the display merely pops into the open position upon activation of the leaf spring(s), assembly directions and opportunity for error are minimal. The display may be erected without any special ability to read and follow instructions.

Yet another advantage is that the component parts themselves are relatively simple with resulting manufacturing economies.

Other features and advantages of the present invention will be apparent from the foil owing, more detailed description of the preferred embodiments, taken in conjunction with the accompanying drawings which illustrate, by way of example, the principles of the invention.

DETAILED DESCRIPTION OF THE INVENTION

Figure 1:
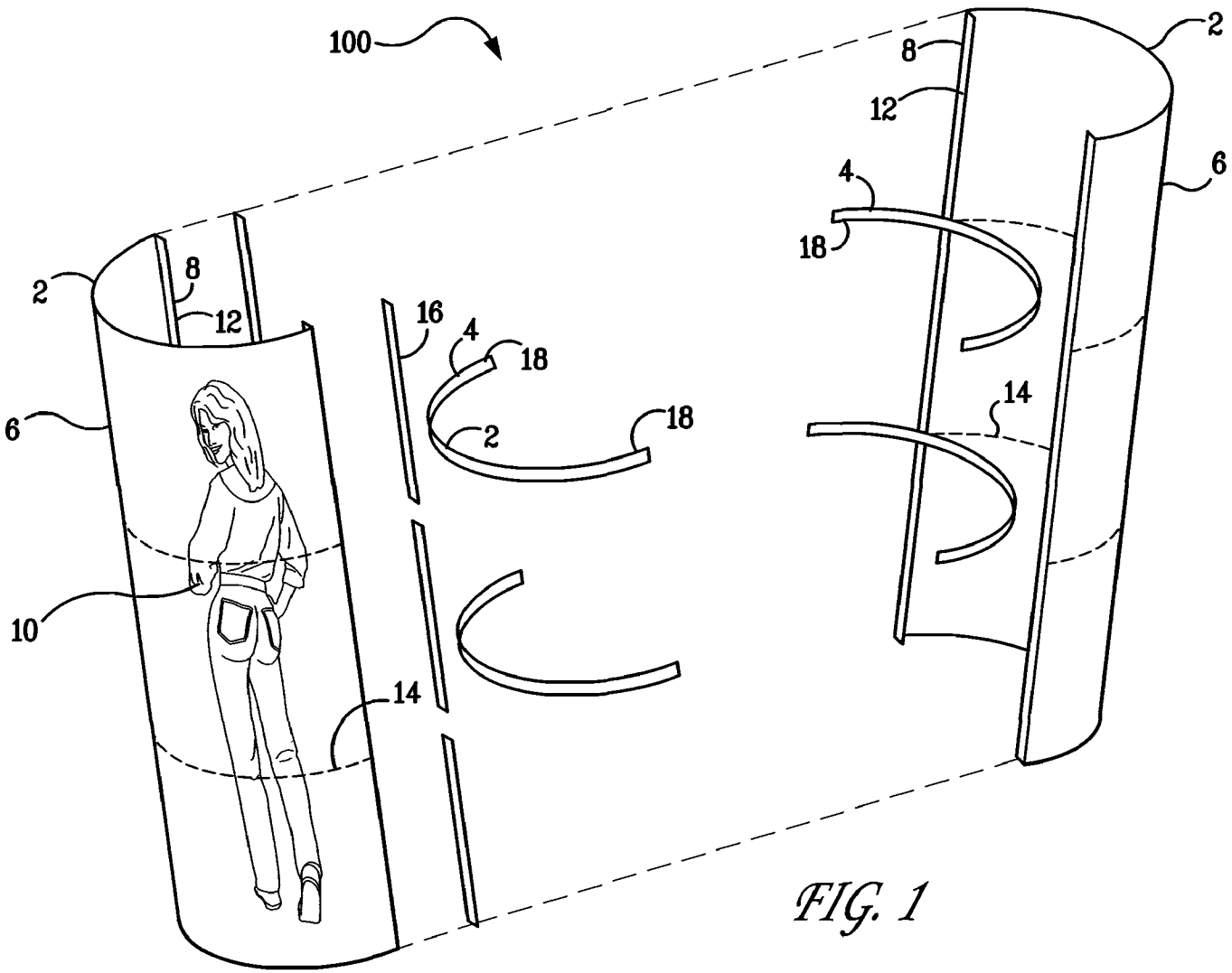
FIG. 1 is an exploded view of a preferred embodiment of the present invention.
Figure 2:
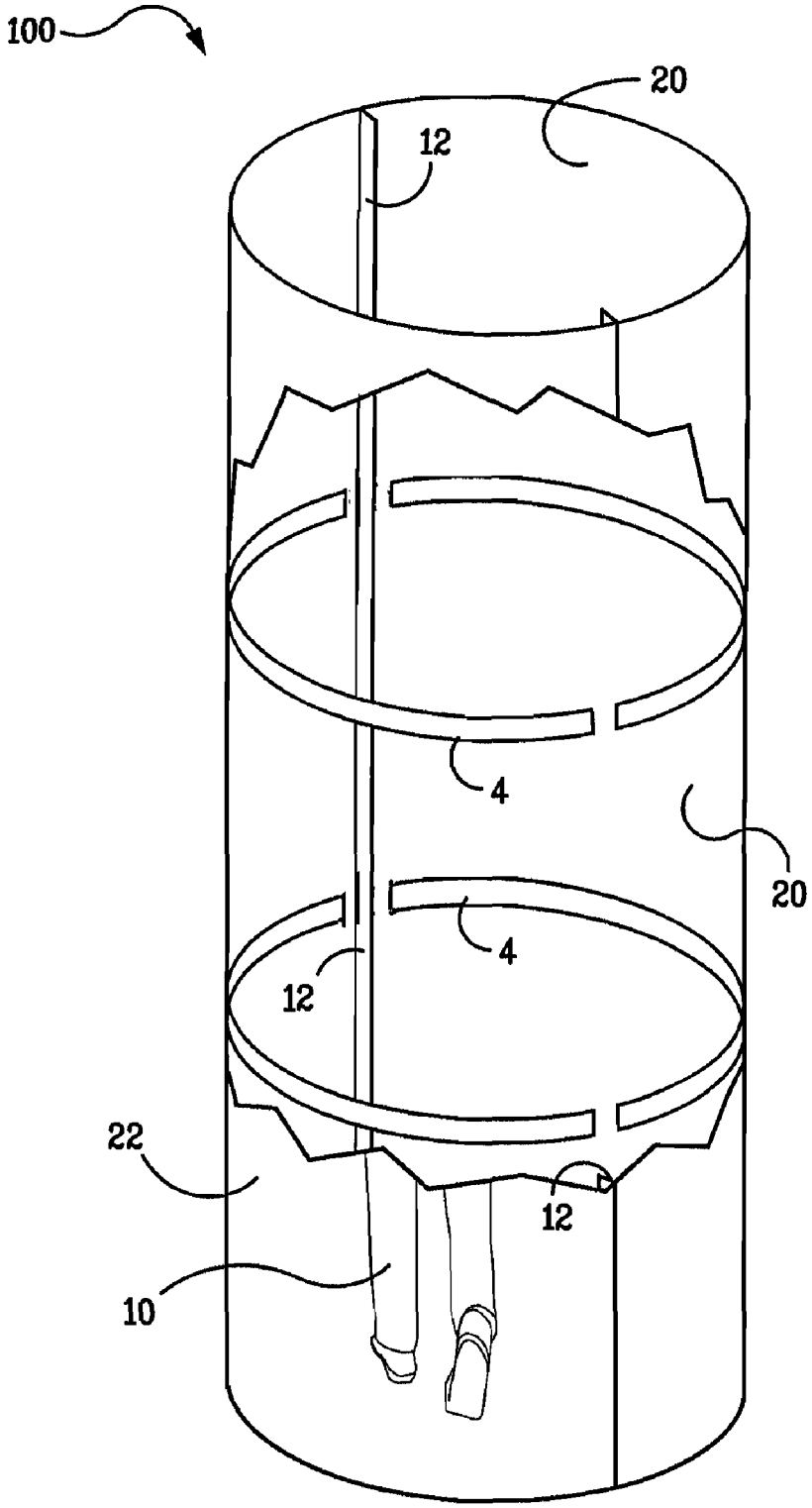
FIG. 2 is an oblique view of the display after leaf spring activation.
Figure 3A:
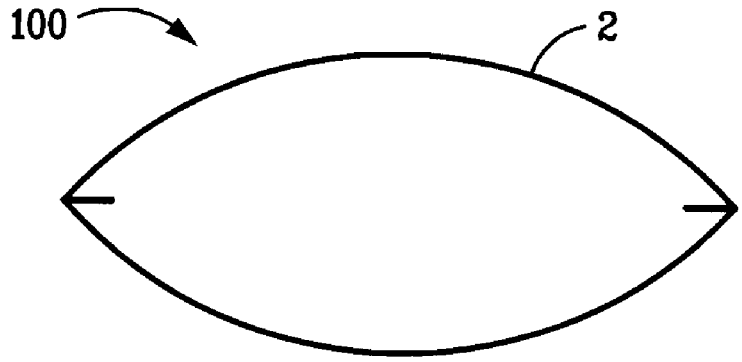
FIG. 3*a* is a top view of the display having an elliptical horizontal cross section.
Figure 3B:
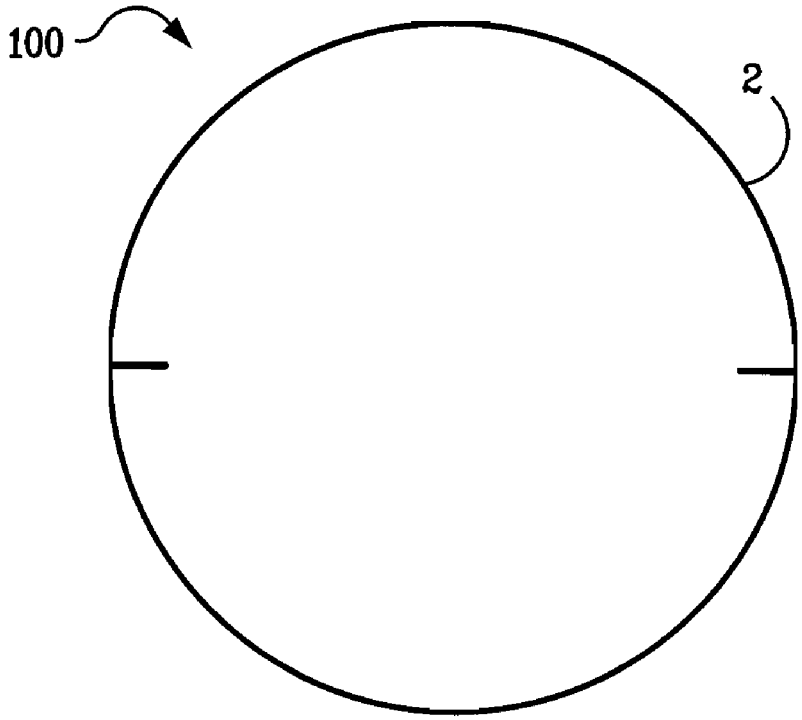
FIG. 3*b* is a top view of the display having a circular horizontal cross section.

Turning to FIGS. 1-3, portable POS display 100 of the present invention comprises two substrates 6 having at least one leaf spring 4 and at least one fold line 14. FIG. 1 is an exploded view of a preferred embodiment. Upon activation of leaf springs 4 (described in detail below), substrates 6 form curved surfaces 2, thereby giving display 100 three dimensional form. For purposes of this disclosure, activation means the return of leaf spring 4 to a predetermined original shape.

Figure 5:
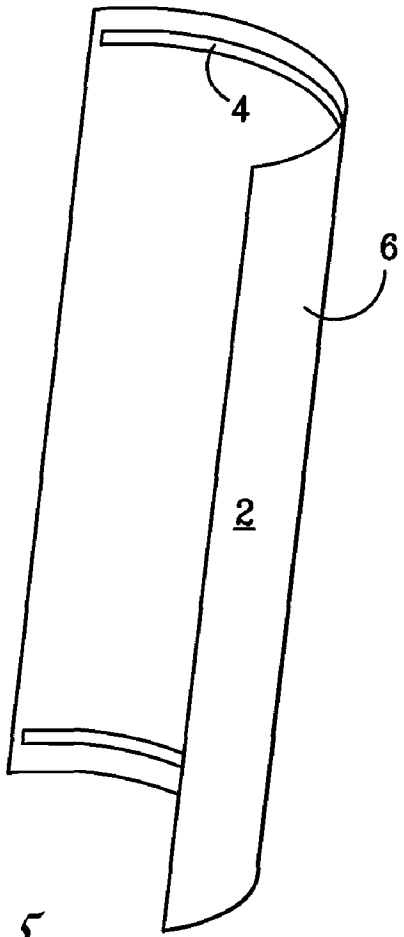
FIG. 5 is an oblique view of an activated substrate.
Figure 4:
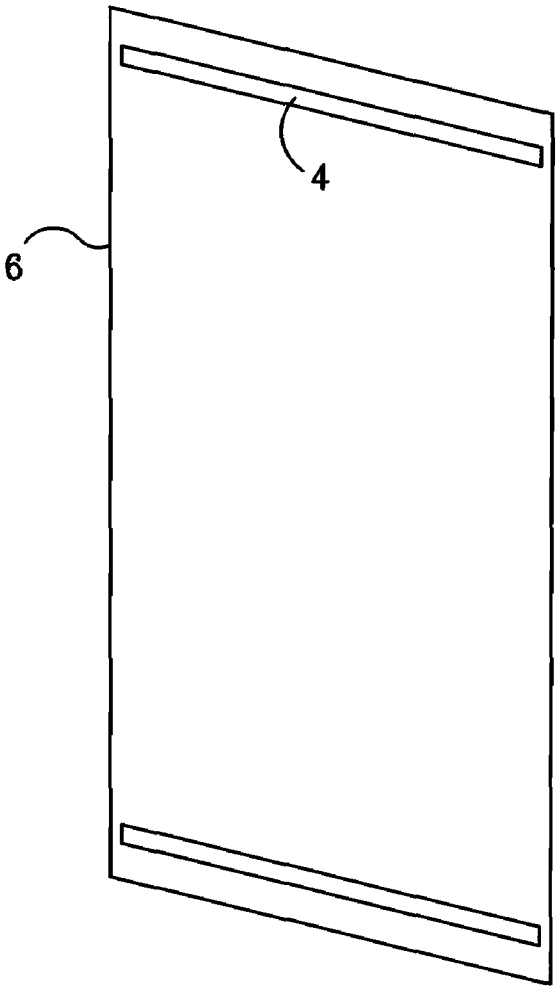
FIG. 4 is an oblique view of an inactivated substrate.

Display material 10, for example, photographs or advertising messages are provided on substrates 6 in a manner known to those skilled in the art. In a preferred embodiment, display material 10 is printed material produced by the offset lithographic printing process prior to assembly of substrates 6. Turning now to FIGS. 4 and 5, once activated, substrates 6 form curved surfaces 2 thereby giving display 100 curved three dimensional outer form which facilitates viewing of the display material 10 from a distance and at a range of angles from display 100.

Figure 6C:
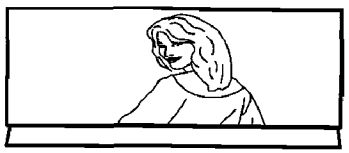
FIGS. 6*a*, 6*b* and 6*c* depict folding for storage of the display.
Figure 6B:
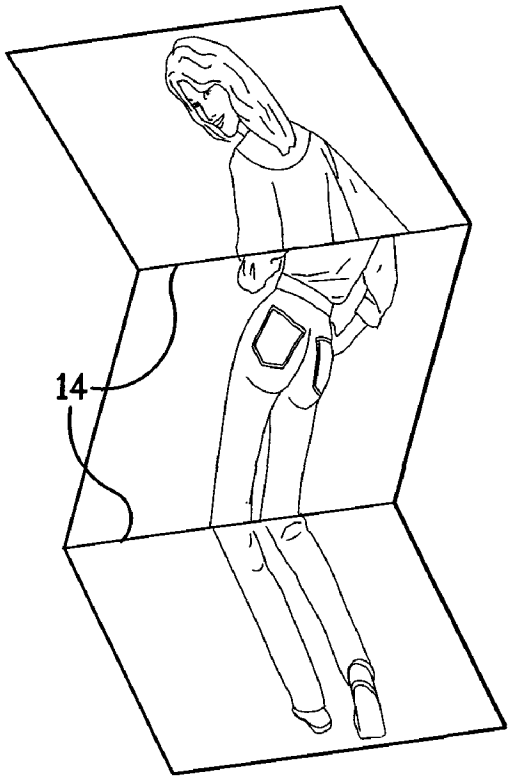
Figure 6A:
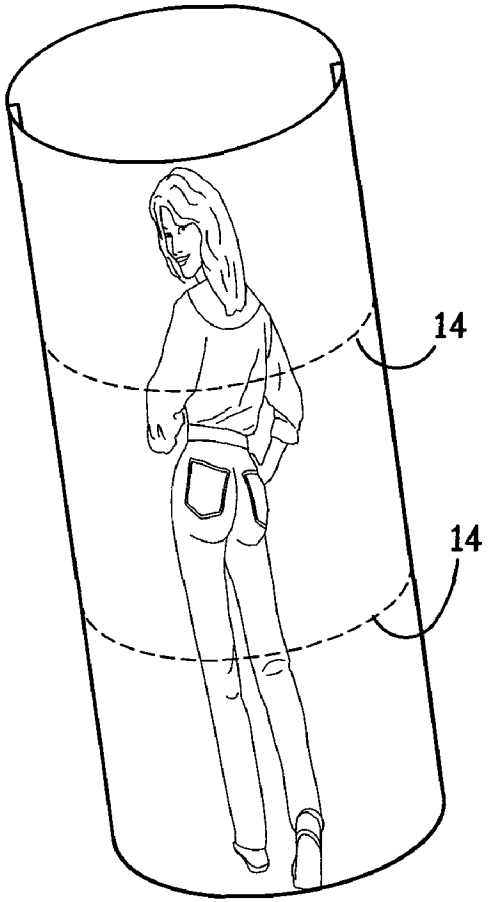

Curved surfaces 2 are preferably formed with geometrically shaped, for example, rectangular, square, trapezoidal, round or oval shaped substrates 6 (FIG. 4). Prior to activation, display 100 folds substantially flat for storage and shipping (FIGS. 6*a*-6*c*), described in detail below. Also described in greater detail below in connection with FIGS. 2, 4, and 5, leaf springs are mounted to display 100 to produce curved surfaces 2 and three dimensional form of display 100 upon activation.

Referring to FIGS. 1, 4, 5, and 7, in a preferred embodiment, display apparatus 100 is formed of two substantially equally dimensioned substrates 6 which are preferentially folded along sides 8. Substrates 6 comprise any flexible material, for example, printing sheet stock, cardboard, laminates sheet plastic and other lightweight flexible materials, including, but not limited to fabrics, capable of receiving display material 10. Preferably, display material 10 is in the form of ink printed upon substrate 6, most preferably by the offset lithographic printing process, prior to component assembly.

Substrates 6 are affixed to one another, preferably adhered to one another. Preferably, folded portions 12 of one substrate 6 is affixed, for example, glued, to folded portions 12 of the other substrate 6. In a preferred embodiment, double sided tape, for example, foam tape 16 having two adherent surfaces is used to adhere folded portions 12 to one another. Optionally, each substrate 6 includes at least one preferential fold line 14, for example, crease lines, positioned to substantially align once display 100 is assembled, thereby allowing compressed display 100 to be folded for shipping, shown in FIGS. 6*a*-6*c*.

Figure 7:
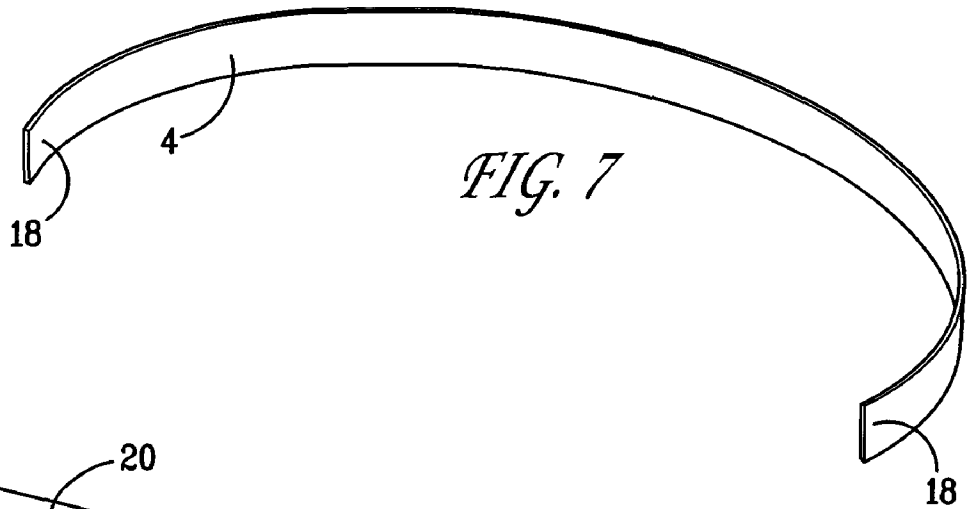
FIG. 7 is an oblique view of a leaf spring prior to assembly to the substrate.

Turning to FIG. 7, leaf spring 4 is comprised of any resilient material capable of returning to a predetermined shape upon activation. Such materials may be, for example, ribbon steel, plastic, and fiberglass. Such predetermined shape may be, for example, a predetermined radius. The predetermined shape of leaf spring 4 will determine the final three dimensional form of display 100. For example, the predetermined shape of leaf spring 4 may be in the form of radius $\alpha$. As radius $\alpha$ in creases in value, the horizontal cross section of display, 100, represented by FIGS. 3*a* and 3*b*, will change from elliptical to circular in form.

At least one leaf spring 4 is mounted to substrate 6. Preferably, leaf spring 4 is fixedly bound to substrate 6 at each terminal end 18. While a single leaf spring 4 is sufficient, preferably, each substrate 6 has at least one leaf spring 4 mounted to it. Optionally, additional leaf springs 4 are utilized to achieve greater support of display 100 as it activates. Optionally, opposing leaf springs 4 in each substrate 6 are offset from one another so as not to contact one another as display 100 is compressed for storage, thereby reducing its folded profile.

While it is preferable that leaf spring 4 be mounted to substrate interior surface 20 (thereby remaining out of sight), the present invention also contemplates embodiments where leaf spring 4 is mounted to substrate exterior surface 22.

Figure 8:
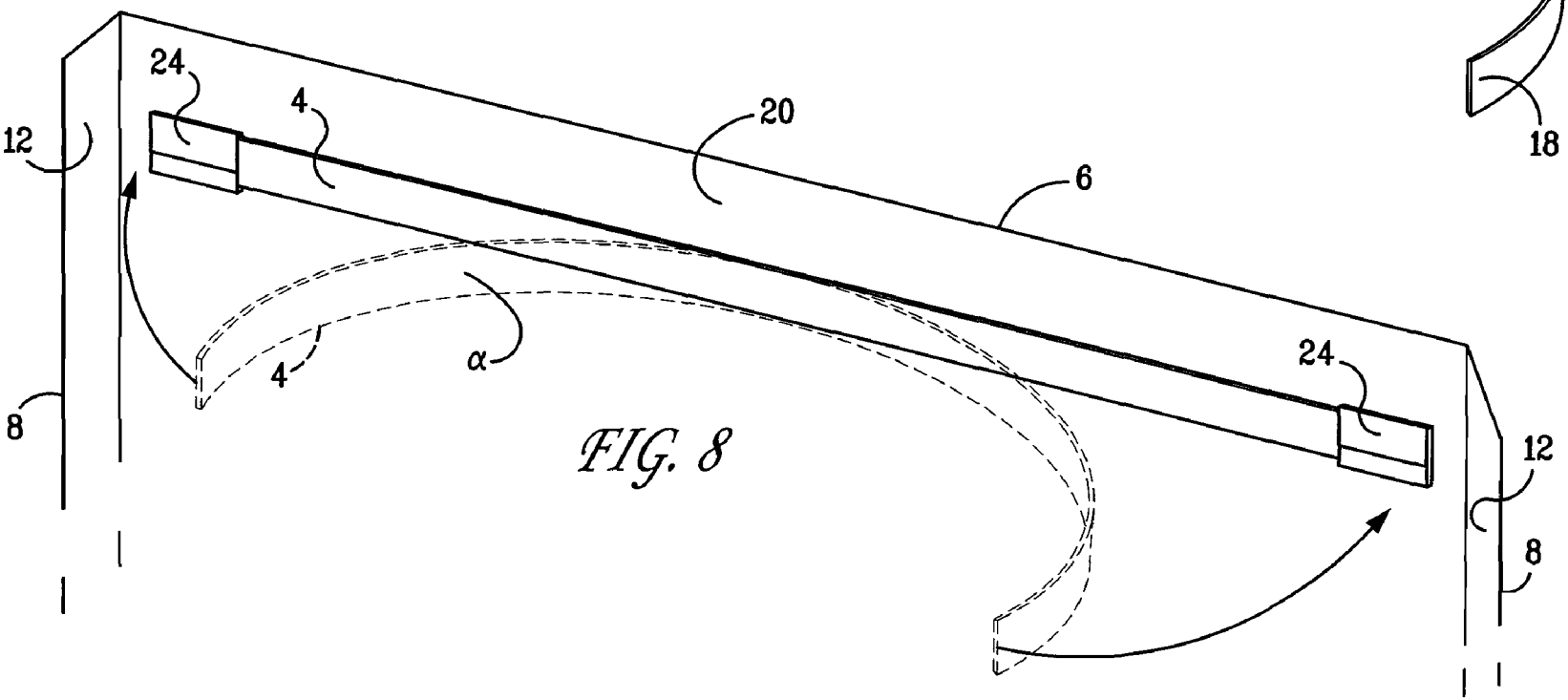
FIG. 8 is an oblique view of a leaf spring after assembly to the substrate.

Rather than directly mounting leaf spring 4 to substrate 6, in an alternate embodiment as shown in FIG. 8, two sleeves 24 each having a first open end and a closed end, for example, a crimped end, are mounted, for example, adhered, to substrate 6. Leaf spring 4 is thereafter inserted into, and retained by, each sleeve 18.

Figure 9:
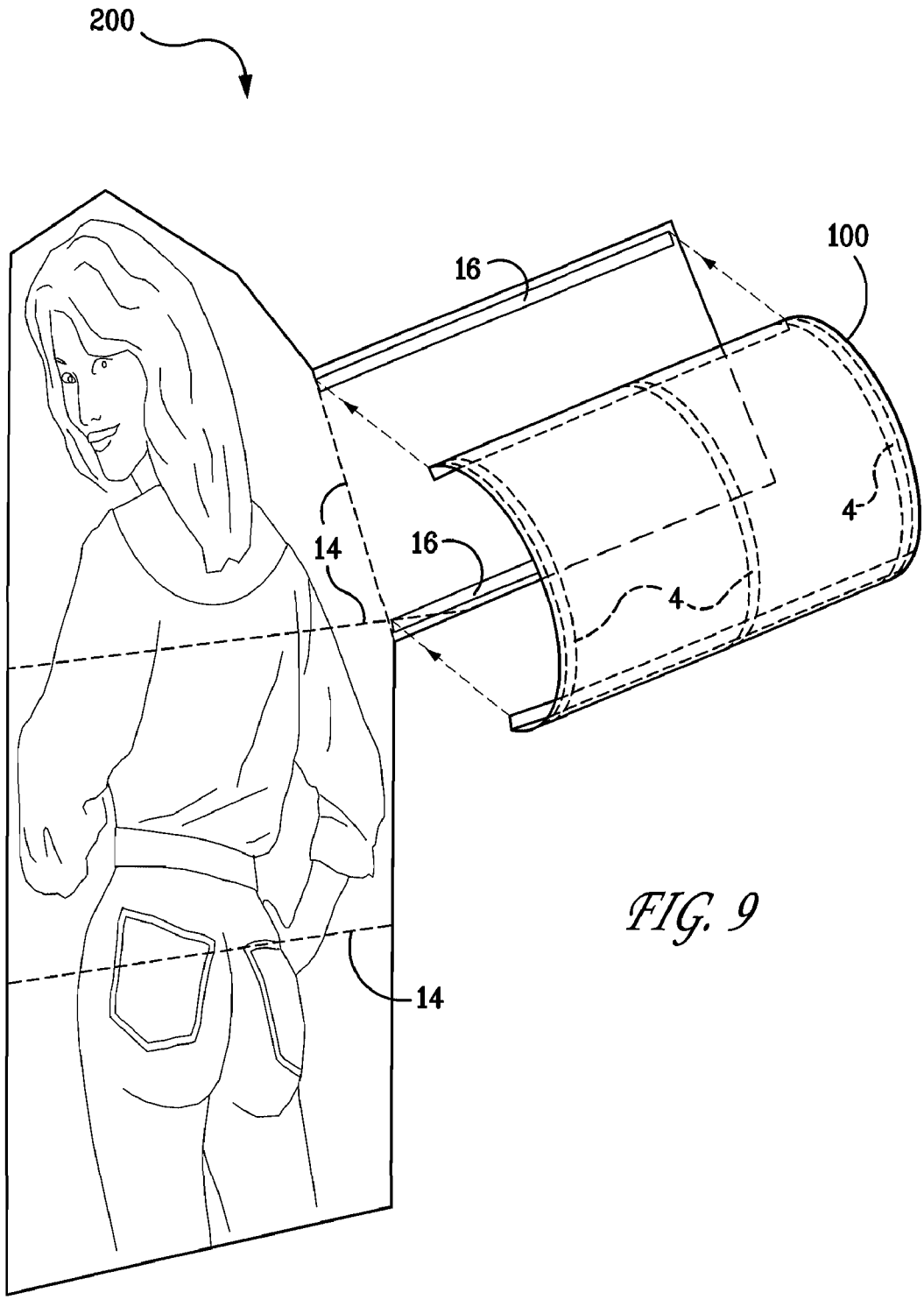
FIG. 9 is an oblique view of the present invention incorporated into a two dimensional POS display.

Turning now to FIG. 9, display 100 may comprise only a portion of a POS display 200, thereby providing POS display 200 with both two dimensional and three dimensional form. Fold lines 14 allow POS display 200 to be folded for storage and shipping.

In a preferred embodiment, display 100 is fabricated and operated as follows. Sheet printing stock is selected as substrate 6 and sized to a predetermined dimension, then run through a lithographic printing press to produce display material 10. Substrate folded portions 12 and fold lines 14 are thereafter formed at predetermined locations. At least one leaf spring 4 having a predetermined shape is affixed to substrate 6, then substrates 6 are affixed to one another along folded portions 12 forming display 100. Display 100 is prepared for shipping by compressing leaf springs 4, thereby flattening display 100 and thereafter folding flattened display on fold lines 14.

Once folded display reaches its destination, display 100 is unfolded thereby permitting leaf springs 4 to activate, "popping" display 100 into its predetermined three dimensional form.

Although the present invention has been described in connection with specific examples and embodiments, those skilled in the art will recognize that the present invention is capable of other variations and modifications within its scope. For example rather than two separate substrates 6, a single sheet stock may be utilized by folding itself such that its two sides 8 are affixed to one another. In this manor, there will be only a single seam. Manufacturing limitations, such as maximum sheet stock width accommodated by a lithographic offset press will determine whether a single sheet stock can be utilized.

These examples and embodiments are intended as typical of, rather than in any way limiting on, the scope of the present invention as presented in the appended claims.

What is claimed is:

1. A pop-up semi self-constructing display comprising a flexible substrate capable of receiving a display material, the substrate having a first part mated to a second part, the parts capable of forming a three dimensional display form, and a leaf spring of predetermined shape attached thereto to allow the display to transition from a substantially flat storage shape to the three dimensional display form upon activation of the leaf spring, wherein a volume of the display form is greater than a volume of the storage shape; the display further comprising a fold line for folding the first part upon the second part to allow the display to transition from the substantially flat folded storage shape to the three dimensional display form upon activation of the leaf spring.

2. The display of claim 1 wherein the display material comprises ink printed upon the substrate.

3. The display of claim 2 wherein the ink is printed using an offset lithographic printing process.

4. The display of claim 1 where in the three dimensional display form includes a curved surface.

5. The display of claim 1 wherein the substrate includes folded sides for mating to one another to form a hollow structure.

6. The display of claim 5 wherein the folded sides are mated using double sided tape.

7. The display of claim 1 wherein the substrate is formed from a flexible material selected from the group consisting of printing sheet stock, cardboard, laminates, and sheet stock.

8. The display of claim 1 wherein the leaf spring predetermined shape is a predetermined radius such that as the predetermined radius increases in value a horizontal cross section of the activated display changes from elliptical to circular in form.

9. The display of claim 1 wherein the leaf spring is fixedly bound to the substrate at each leaf spring terminal end.

10. The display of claim 1 wherein the substrate includes two sleeves mounted to the substrate, each sleeve having a first open end and a second closed end, the sleeves positioned on the substrate to each insertively receive a leaf spring terminal end.

11. A pop-up semi self-constructing display comprising first and second flexible substrate mated to one another to form a hollow structure; at least one substrate capable of receiving a display material; wherein at least one substrate further includes a leaf spring of predetermined shape attached thereto to allow the display to transition from a substantially flat storage shape to a three dimensional display form upon activation of the leaf spring, wherein a volume of the three dimensional display form is greater than a volume of the storage shape, the display further comprising a corresponding fold line in each flexible substrate for folding the display upon itself, the corresponding fold lines positioned to substantially align at a predetermined location to allow the display to transition from the substantially flat folded storage shape to the three dimensional display form upon activation of the leaf spring.

12. The display of claim 11 wherein the display material comprises ink printed upon the at least one substrate.

13. The display of claim 12 wherein the ink is printed using an offset lithographic printing process.

14. The display of claim 11 where in the three dimensional display form includes a curved surface.

15. The display of claim 11 wherein the first and second substrates each have folded sides for mating the two substrates.

16. The display of claim 15 wherein the folded sides are mated using double sided tape.

17. The display of claim 11 wherein the substrate is formed from a flexible material selected from the group consisting of printing sheet stock, cardboard, laminates, and sheet stock.

18. The display of claim 11 wherein the leaf spring predetermined shape is a predetermined radius such that as the predetermined radius increases in value a horizontal cross section of the activated display changes from elliptical to circular in form.

19. The display of claim 11 wherein the leaf spring is fixedly bound to the at least one substrate at each leaf spring terminal end.

20. The display of claim 11 wherein the at least one substrate further includes two sleeves mounted to the substrate, each sleeve having a first open end and a second closed end, the sleeves positioned on the at least one substrate to each insertively receive a leaf spring terminal end.

21. The display of claim 11 wherein the first and second flexible substrate each have a leaf spring attached thereto.

22. The display of claim 21 wherein the leaf springs are offset so as not to contact one another as the display is transitioned to the substantially flat storage shape.

23. The display of claim 11 wherein the transitioned three dimensional display form comprises only a portion of the display.

24. A method of fabricating a pop-up semi self-constructing display comprising the steps of:

a. selecting and sizing a substrate to a predetermined dimension;

b. placing a display material on the substrate;

c. affixing a leaf spring of predetermined shape to the substrate at a predetermined location;

d. affixing a substrate first and second side to one another forming a hollow structure;

e. compressing the substrate to form a flattened display for shipping, wherein a volume of a constructed display is greater than a volume of the flattened display, the display further comprising a fold line for folding the substrate upon itself, the fold line located at a predetermined location to allow the display to transition from a substantially flat folded storage shape to a three dimensional display form upon activation of the leaf spring.

25. A method of fabricating a pop-up semi self-constructing display comprising the steps of:

a. selecting and sizing a first and second substrate each to a predetermined dimension;

b. placing a display material on at least one substrate;

c. affixing a leaf spring of predetermined shape to at least one substrate at a predetermined position;

d. mating the first and second substrate to one another at respective first and second sides to form a hollow structure;

e. compressing the mated substrates to form a flattened display for shipping, wherein a volume of the constructed display form is greater than a volume of the flattened display, the display further comprising a corresponding fold line in each substrate for folding the display material upon itself, the corresponding fold lines positioned to substantially align at a predetermined location to allow the display to transition from the flattened display to the constructed display upon activation of the leaf spring.

26. The method of claim 25 wherein the respective first and second sides each have folds for mating the first and second substrates.

* * * * *